US008601970B1

(12) United States Patent
Dorsky

(10) Patent No.: US 8,601,970 B1
(45) Date of Patent: Dec. 10, 2013

(54) TETHERED BUOY HOUSING AND DEPLOYMENT ASSEMBLY

(75) Inventor: Jason M. Dorsky, Brooklyn, NY (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 323 days.

(21) Appl. No.: 13/159,083

(22) Filed: Jun. 13, 2011

(51) Int. Cl.

| | |
|---|---|
| ***B63G 8/04*** | (2006.01) |
| ***B63G 8/38*** | (2006.01) |
| ***B63G 8/39*** | (2006.01) |
| ***B63G 8/42*** | (2006.01) |
| ***H01Q 1/04*** | (2006.01) |
| ***H01Q 1/34*** | (2006.01) |

(52) U.S. Cl.
USPC ..... 114/328; 114/244; 114/322; 114/326; 114/339; 343/709

(58) Field of Classification Search
USPC ..... 114/316–329, 339, 340, 244, 245; 340/850; 343/709, 710
See application file for complete search history.

(56) References Cited

U.S. PATENT DOCUMENTS

| | | | | |
|---|---|---|---|---|
| 1,673,791 | A * | 6/1928 | Boyron | 114/324 |
| 2,341,923 | A * | 2/1944 | Kotelev et al. | 114/324 |
| 2,801,605 | A * | 8/1957 | Hoke, Jr. | 114/324 |
| 3,034,471 | A * | 5/1962 | Aschinger | 114/244 |
| 4,533,945 | A * | 8/1985 | Lauvray et al. | 348/144 |
| 7,000,561 | B2 * | 2/2006 | Kruger et al. | 114/339 |
| 8,171,873 | B2 * | 5/2012 | Woolwright et al. | 114/322 |
| 8,186,295 | B2 * | 5/2012 | Fournier | 114/332 |

FOREIGN PATENT DOCUMENTS

WO WO 2005000667 A2 * 1/2005

* cited by examiner

*Primary Examiner* — Ajay Vasudeva
(74) *Attorney, Agent, or Firm* — James M. Kasischke; Michael P. Stanley

(57) ABSTRACT

A tethered buoy housing and deployment system includes a housing for disposition in a vessel, a tether for interconnecting a portion of the housing and a buoy, a reel mounted in the housing and rotatable to unwind the tether, means for maintaining tension on the tether as the tether is unwound, and a platform and linkage assembly adapted to support the buoy and move the buoy between a vertical disposition for storage in the housing and an angled disposition for release of the buoy into an external fluid stream.

15 Claims, 7 Drawing Sheets

TETHERED BUOY HOUSING AND DEPLOYMENT ASSEMBLY

STATEMENT OF GOVERNMENT INTEREST

The invention described herein may be manufactured and used by or for the Government of the United States of America for Governmental purposes without the payment of any royalties thereon or therefore.

CROSS REFERENCE TO OTHER PATENT APPLICATIONS

None.

BACKGROUND OF THE INVENTION

1) Field of the Invention

This invention relates to a tethered buoy housing and deployment assembly adapted to lift and rotate a buoy from a stowed location in an undersea vessel to a position wherein the buoy can be released into an underwater flow stream and thereafter retrieved and returned to the housing.

2) Description of the Prior Art

The United States Navy has developed an antenna assemblies for submarines, in which the assemblies are adapted to improve communications at maneuvering speeds and depths. One such system is the Recoverable Tethered Optical Fiber (RTOF) buoy, which is deployed to the surface and recovered by an attached tether. Current RTOF buoy system is designed to fit within a relatively large working volume. As such there is a need for a buoy system which can operate in a relatively smaller space.

SUMMARY OF THE INVENTION

It is therefore a primary object and general purpose of the present invention to provide a tethered buoy housing and deployment assembly which can be used in smaller sized environments.

With the above object in view, a feature of the present invention is the provision of a tethered buoy housing and deployment assembly comprising a housing for disposition in a sail portion of a submarine or similar structure of an undersea vessel, a tether for interconnecting a portion of the housing and a portion of a buoy, a tether reel mounted in the housing and rotatable to unwind the tether, means for maintaining a selected tension on the tether as the tether is unwound, a platform disposed in the housing and adapted to rise in the housing as the tether is extended, a buoy cradle for releasably retaining the buoy, and a linkage assembly mounted on the platform and adapted to move the buoy between a substantially vertical disposition for retention of the buoy and a tilted disposition for generally aligning the buoy with external water flow for release of the buoy thereinto.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, and wherein corresponding reference characters indicate corresponding parts throughout the several views of the drawings, and wherein.

DETAILED DESCRIPTION OF THE INVENTION

Figure 1:
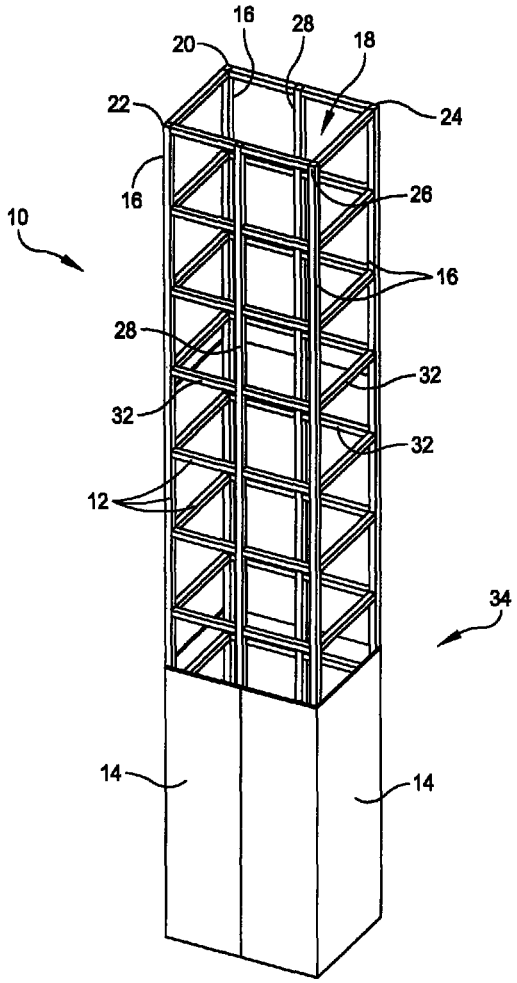
FIG. 1 is a perspective view of a housing structure of the present invention with a plurality outer plates removed in order to show inner structure components.
Figure 8:
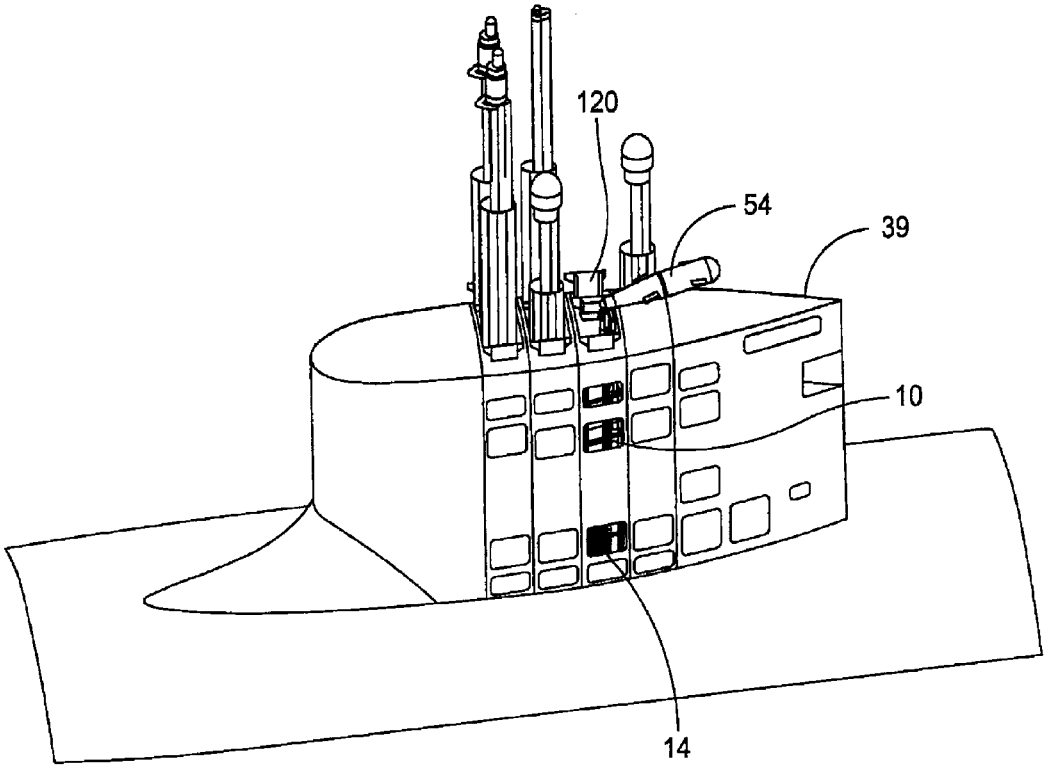
FIG. 8 is a perspective view of a sail portion of a submarine with the buoy deployment system of the present invention disposed therein.

In the present invention, a caged housing structure 10 is constructed of preferably 1.5 inch×1.5 inch bars 12 enclosed by plates 14 (FIG. 1). Four parallel vertical bars 16, each approximately 181.5 inches in length, are arranged so as to frame a rectangle 18 and make up corners 20, 22, 24, 26 of the housing structure 10. An extra 181.5 inch long bar 28 is added to the two longer sides of the rectangle for support. Perpendicular to the vertical bars are several smaller horizontal bars 32 (either 14.25 inches or 22.5 inches in length) that support the vertical bars 12. The bars 16, 32 are welded together to form a cage 34, with the plates 14 (approximately 0.25 inches thick, and approximately either 26 inches×60.5 inches or 16.75 inches×60.5 inches) welded to the outside of the cage for added stability against shock. The assembled cage 34 is mounted on a foundation plate 38 inside sail 39 (FIG. 8).

Figure 2:
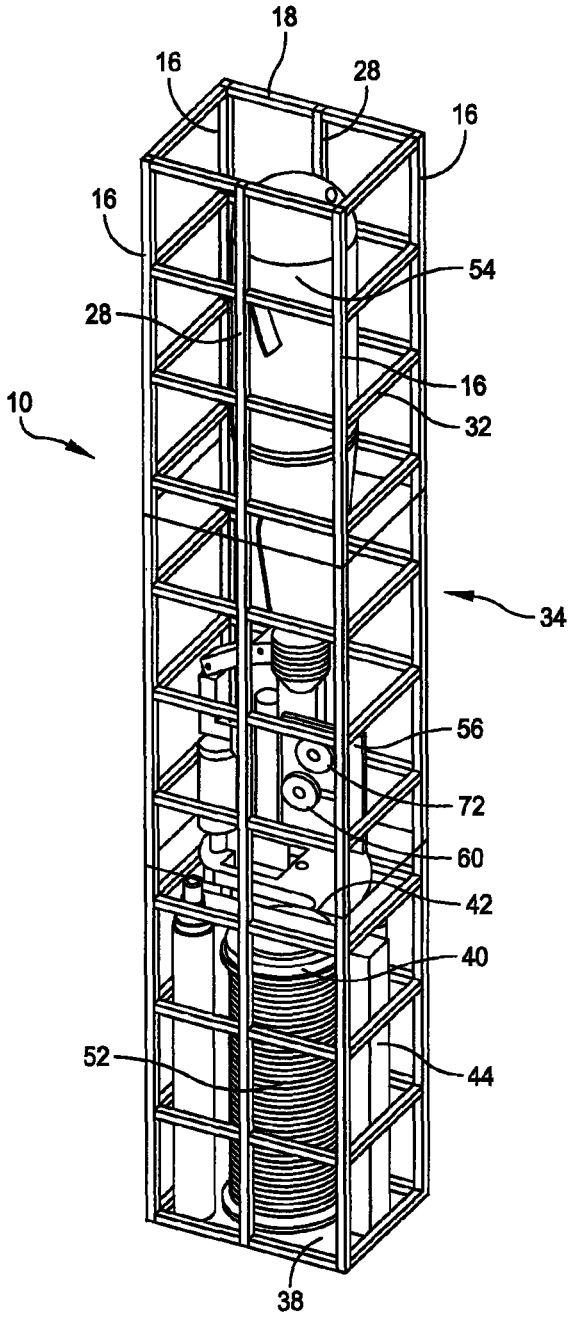
FIG. 2 is a perspective view of the inner structure of the housing of FIG. 1, with components of the deployment system and a buoy contained therein.
Figure 3:
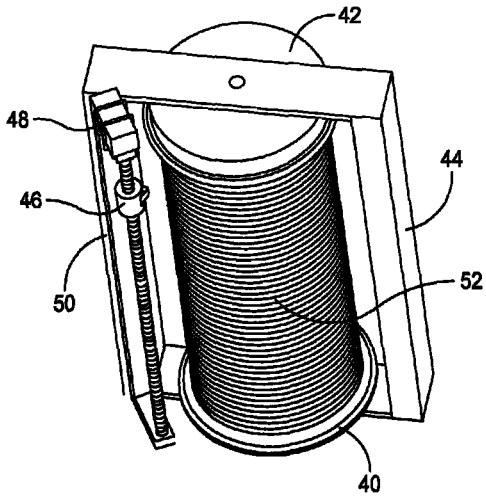
FIG. 3 is a perspective view of a tether and spool mechanism of the present invention.

As shown in FIG. 2, at the bottom of the cage 34, there is mounted a tether reel 40 and DC brushless pancake motor 42. The pancake motor 42 is mounted on top of the reel 40 and rotates with the reel. A tether reel containment structure 44 protects the reel 40 and pins the reel through the center thereof, allowing the reel to spin but not move from its location. The containment structure 44 also provides support for a level wind 46 and the DC motor 48 (See FIG. 3). The level wind 46 protrudes from one side of the containment structure 44, and the DC motor 48 is mounted on top of a protrusion 50 (FIG. 3 and FIG. 6) and is locked down to avoid movement during operation.

Figure 4:
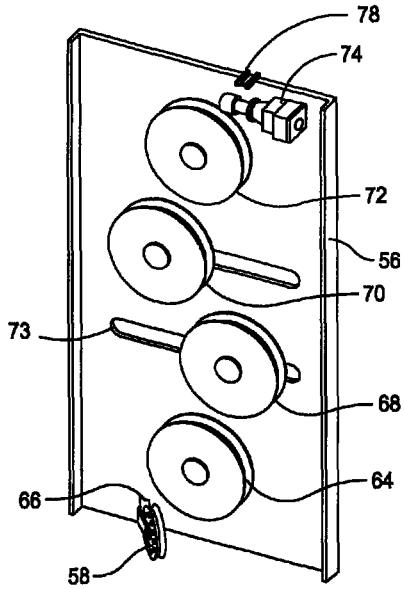
FIG. 4 is a perspective view of a tether tension sensor assembly and a tether cutter of the present invention.
Figure 5:
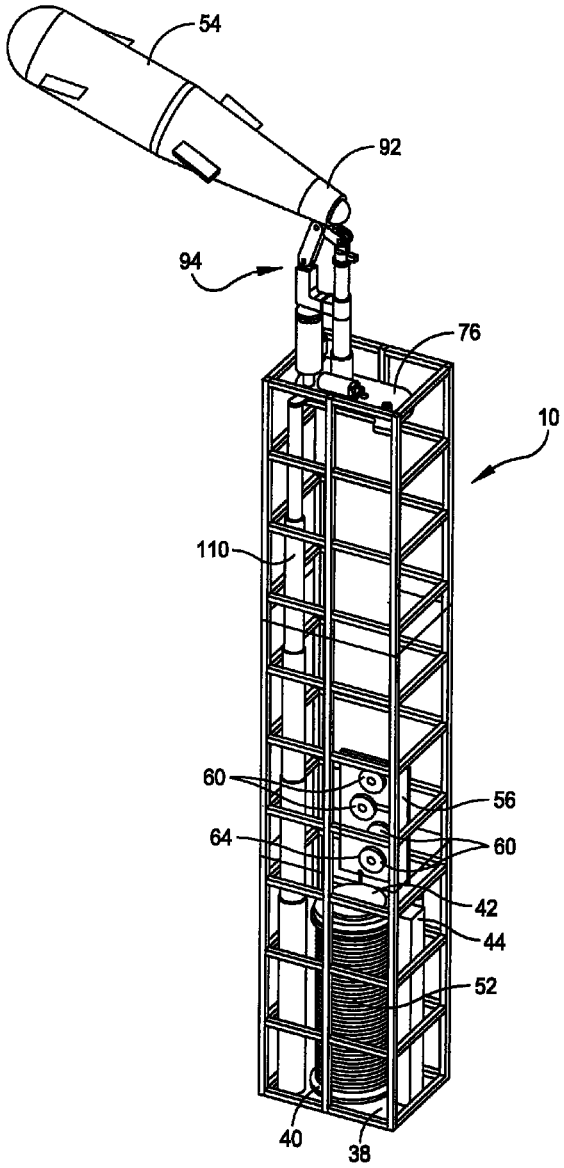
FIG. 5 is a perspective view of a tether reel and motor assembly disposed within the housing.

When a tether 52 leaves the reel 40 and goes through the level wind 46, a first stop on the way to a buoy 54 is a low tension sensor 56 (See FIG. 4). An alignment pulley 58, part of an array of tether path elements, at the bottom of an array of the tension sensors directs the tether 52 into a first sensor pulley 64. The alignment pulley 58 is adapted to swivel back and forth on a pin 66 to accommodate how the tether 52 is coming off of the level wind 46.

The sensor pulleys 64, 68, 70, 72 are arranged such that the top and bottom pulleys 72, 64 are locked in place, while the two middle pulleys 68, 70 can translate laterally, left to right (side-to-side) within apertures 73. The two middle pulleys 68, 70 sense how far their centers of rotation are away from each other and an operationally-connected inboard computer (not shown) translates the distance into tether tension. When the tension is too low or too high, an operator is signaled there is a problem.

The tether 52 comes in from the alignment pulley 58 and extends clockwise around the bottom sensor pulley 64, counterclockwise around the next pulley up 68, clockwise around the next pulley 70, and counterclockwise around the top sensor pulley 72.

When the tether 52 leaves the top pulley 72, the tether moves through a tether cutter 74 before continuing on. The tether cutter 74 is used in situations where the buoy 54 cannot be saved. The tether cutter 74 is activated by a small solenoid with a stored-energy device.

Figure 6:
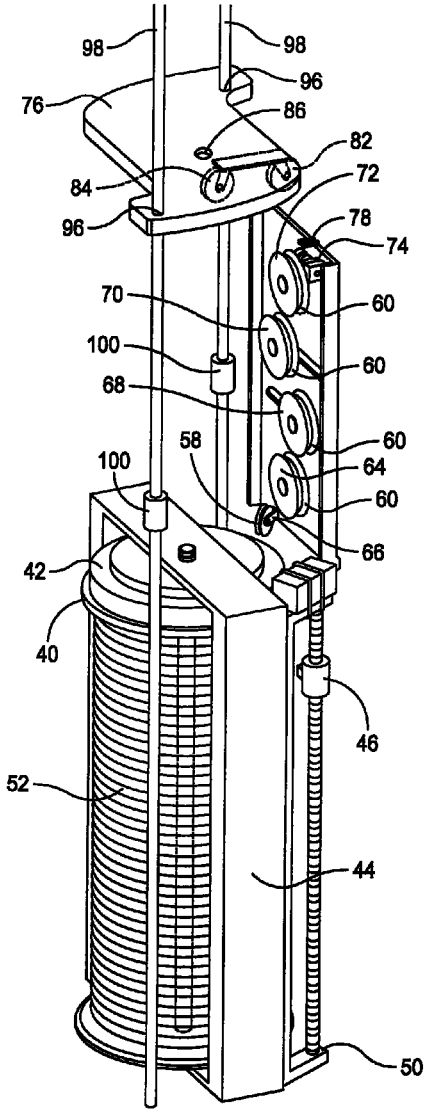
FIG. 6 is a perspective view of the components of FIGS. 3 and 5, in combination with a lift platform.

The path from the reel 40 to the buoy 54 is provided by the tether path elements 60, as shown in FIG. 6. When the tether 52 leaves the level wind 46; the first of the tether path elements encountered is the alignment pulley 58, and thereafter the sensor pulleys 64, 68, 70, 72. As the tether 52 leaves the tether cutter 74 on the other end of the low tension sensor 56; the tether passes through one of two small rollers on its way to a lift platform 76 to ensure that the tether 52 travels the correct path without changing direction.

Figure 7:
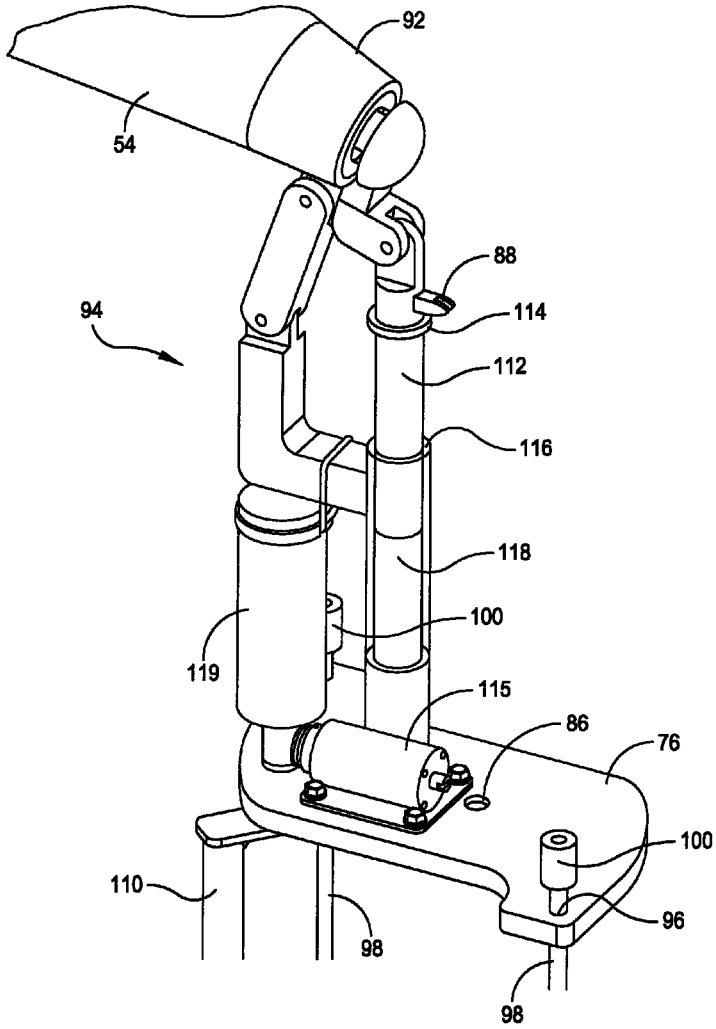
FIG. 7 is a perspective view of a buoy deployment and retrieval assembly mounted on the lift platform.

Roller 78 can be added proximate to the sensor pulley 72 while another roller (not shown) can be mounted proximate to platform pulleys 82, 84. Following the platform pulleys, the tether 52 passes through an orifice 86 in a lift platform 76, where the tether 52 passes through a further roller 88 for alignment (FIG. 7) before connecting to the buoy 54 through a buoy cradle 92.

The lift platform 76 is a base for a linkage deployment and retrieval mechanism 94. The platform 76 may be made from 1.0 inch thick steel. Holes 96 are disposed at each end of the platform 76 for lift platform support rods 98. The rods 98 are provided with rubber support rod translation brakes 100 located on the rods, to avoid over-and-under extension of a hydraulic lift cylinder 118.

The lift platform 76 is raised to a proper height by a five-stage double-acting hydraulic cylinder 110 and guided along the correct path by the lift platform support rods 98. Prior to rotation, an inner lifting link 112 of varying relative length is in a lowered position, so that a linkage brake 114 is resting on a base link 116.

To achieve rotation, the lifting link 112 is raised. This is effected by the electrical lift cylinder 118 and a DC motor 119. The cylinder 110 may be driven by a one-horsepower, three-phase AC induction brake motor 115.

The motor 115 is supported by the lift platform 76. This arrangement prevents a large moment from being applied to the motor 119. The lift cylinder 118 is vertically actuated by the motor 119 and pushes up on the link 112 of varying relative length, causing the link with the buoy cradle 92 attached thereto, to rotate into position.

The tethered buoy housing and deployment system satisfies the requirements for an outboard antenna system. The maximum hydraulic power supplied by the platform is seventy-six gal/min at 3000 psi, which is more than is required to power the five-stage double-acting hydraulic cylinder 110. The available electricity is also sufficient to run the DC motors in the system.

The above described system is sufficiently robust to handle hydrodynamic loading. The electric lift cylinder 118 and DC motor 119 are able to actuate deployment and retrieval in the same scenario.

At a platform depth and speed determined to be optimal by the submarine for use of the RTOF, deployment is initiated. At this point, closure doors on the sail 39 are opened and the five-stage double-acting hydraulic cylinder 110 is actuated through inboard controls (See FIG. 8). The hydraulic cylinder 110 pushes the lift platform 76 to a pre-specified height. At this point, the electric lift cylinder 118 and DC motor 119 take over.

Using inboard controls, the lift cylinder 118 is raised to the point at which the deployment mechanism 94 lines up the buoy 54 with the external water flow. The tether reel 40 then releases back tension on the tether 52, which allows the flow caused by the moving submarine to carry the buoy 54 out of the buoy cradle 92. The inherent lift buoyancy of the buoy 54 then lifts the buoy to the surface.

When the RTOF is released, it remains stationary on the surface while the reel releases the tether 52 in accordance with the forward velocity of the carrying vessel. When the tether 52 runs out, the buoy slips under the surface quickly, leaving a minimal wake.

The buoy 54 remains stationary on the surface of the ocean while the carrying vessel moves forward; thereby, causing the tether 52 to unfurl. Once the end of the tether 52 is reached, the tether reel 40 and DC brushless pancake motor 48 quickly pull the buoy 54 under the surface and reels the buoy back in. When the buoy 54 is pulled back in to the buoy cradle 92; the electric lift cylinder 118 is lowered, rotating the buoy back to the vertical stowage position. The five-stage double-acting hydraulic cylinder 110 is then lowered and closure doors 120 are shut, completing the full stowage operation of the system.

It will be understood that many additional changes in the details, materials, steps and assignment of parts, which have been herein described and illustrated in order to explain the nature of this invention, may be made by those skilled in the art within the principles and scope of the invention as expressed in the appended claims.

What is claimed is:

1. A tether buoy housing and deployment assembly comprising:

a housing capable of disposition in a vessel;

a tether for interconnecting a portion of said housing and a portion of a buoy;

a tether reel mounted in said housing and rotatable to unwind said tether;

means for maintaining a selected tension on said tether as said tether is unwound;

a lift platform disposed in said housing and adapted to rise in said housing as said tether is extended;

a buoy cradle for retaining the buoy; and a linkage assembly mounted on said platform and adapted to move the buoy between a substantially vertical disposition for retention of the buoy and a tilted disposition for generally aligning the buoy with external water flow for release of the buoy into a water flow;

wherein said housing comprises a skeletal cage comprising rigid bars joined to form an elongated structure;

wherein plates are mounted on said rigid bars to form a substantially enclosed box-like structure.

2. The assembly in accordance with claim 1, wherein said tether reel is rotatably mounted in said box-like structure and adapted to support, unwind and rewind said tether thereon.

3. The assembly in accordance with claim 2, wherein said tension means is capable of maintaining tension and spacing on said tether during winding of said tether.

4. The assembly in accordance with claim 3, wherein said lift platform disposed is capable of movement toward said reel as said tether is retrieved.

5. The assembly in accordance with claim 2, and further comprising a tether reel containment structure for rotatably mounting said reel, and a motor mounted on said reel for starting, stopping and reversing rotation of said reel, and for mounting a level wind and level wind motor.

6. A tether buoy housing and deployment assembly comprising:

a housing capable of disposition in a vessel;

a tether for interconnecting a portion of said housing and a portion of a buoy;

a tether reel mounted in said housing and rotatable to unwind said tether;

means for maintaining a selected tension on said tether as said tether is unwound;

a lift platform disposed in said housing and adapted to rise in said housing as said tether is extended;

a buoy cradle for retaining the buoy; and a linkage assembly mounted on said platform and adapted to move the buoy between a substantially vertical disposition for retention of the buoy and a tilted disposition for generally aligning the buoy with external water flow for release of the buoy into a water flow;

wherein said means for maintaining a selected tension on said tether as said tether is being unwound comprises a low tension sensor including pulley mount proximate said tether reel and having a plurality of tether path pulley wheels mounted thereon, each of the pulley wheels being adapted to receive said tether therearound.

7. The assembly in accordance with claim 6, wherein said pulley wheels comprise first, second, third, and fourth pulley wheels mounted on a support member, and adapted for acting upon said tether as said tether is withdrawn from said tether reel.

8. The assembly in accordance with claim 7, wherein said first and fourth pulley wheels are rotatable about fixed points on said support member and said second and third pulley wheels are moveable laterally on said support member to maintain a selected tension on said tether.

9. The assembly in accordance with claim 7, wherein said lift platform is movable on support rods extending upwardly proximate to said tether reel.

10. The assembly in accordance with claim 9, and further comprising a linkage assembly mounted on said lift platform and pivotally connected to said buoy cradle.

11. The assembly in accordance with claim 10, wherein said linkage assembly comprises a cylindrical sleeve upstanding from said lift platform, a lift cylinder slidably disposed in said sleeve and extending outwardly from a free end of said sleeve, a free end of said lift cylinder being pivotally connected to an end portion of said buoy cradle, and a linkage assembly fixed at a first end thereof to said sleeve and at a second end thereof to said buoy cradle, and having a pivot joint between the first and second ends, such that axial movement of said lift cylinder causes pivotal movement of said second end of said linkage assembly and thereby movement to said buoy cradle.

12. The assembly in accordance with claim 11, wherein a motor is mounted on said lift platform and is operable to drive said linkage assembly between a first position in which said buoy is in substantial alignment with said lift cylinder and a second position in which said buoy is generally transverse to said alignment.

13. A tethered buoy housing and deployment assembly comprising a housing for disposition in a sail portion of a vessel, a tether for interconnecting a portion of said housing and a buoy, a reel mounted in said housing and rotatable to unwind said tether, means for maintaining tension on said tether as said tether is unwound, and a platform and linkage assembly adapted to support the buoy and move the buoy between a vertical disposition for storage in said housing and an angled disposition for release of the buoy into a fluid stream wherein said means for maintaining tension of said tether comprises a plurality of pulleys rotatably mounted on a sensor plate, each of said pulleys being rotatable about an axis thereof and adapted to receive said tether about a periphery thereof, at least one of said pulleys being movable laterally in response to engagement thereof by said tether, to maintain a selected tension on said tether.

14. The tethered buoy housing and deployment system in accordance with claim 13, whereas said platform and linkage assembly comprises a base link sleeve upstanding from a lift platform, a linkage rod extending from a free end of said sleeve, an arm fixed to said sleeve and extending outwardly therefrom, said linkage rod being pivotally connected at an end thereof remote from said base link sleeve to a buoy cradle, and said arm comprises a portion of a linkage connected to the buoy cradle, such that the buoy is movable between storage and release dispositions.

15. The tethered buoy housing and deployment system in accordance with claim 14, wherein a brake and tether path guide are disposed on said arm.

* * * * *